US009772077B2

(12) United States Patent
Kretschmann

(10) Patent No.: US 9,772,077 B2
(45) Date of Patent: Sep. 26, 2017

(54) OPERATING LAMP FOR GENERATING A TOTAL LIGHT FIELD CONSISTING OF PARTIAL LIGHT FIELDS

(71) Applicant: Drägerwerk AG & Co. KGaA, Lübeck (DE)

(72) Inventor: Hanno Kretschmann, Hamburg (DE)

(73) Assignee: Drägerwerk AG & Co. KGaA, Lübeck (DE)

( * ) Notice: Subject to any disclaimer, the term of this patent is extended or adjusted under 35 U.S.C. 154(b) by 0 days.

(21) Appl. No.: 15/132,570

(22) Filed: Apr. 19, 2016

(65) Prior Publication Data

US 2016/0305647 A1 Oct. 20, 2016

(30) Foreign Application Priority Data

Apr. 20, 2015 (DE) ..... 10 2015 004 969

(51) Int. Cl.

| | |
|---|---|
| ***F21V 9/00*** | (2015.01) |
| ***F21S 8/00*** | (2006.01) |
| *F21W 131/205* | (2006.01) |
| *F21Y 113/00* | (2016.01) |
| *F21Y 115/10* | (2016.01) |
| *F21Y 113/13* | (2016.01) |

(52) U.S. Cl.

CPC ..... *F21S 8/00* (2013.01); *F21W 2131/205* (2013.01); *F21Y 2113/00* (2013.01); *F21Y 2113/13* (2016.08); *F21Y 2115/10* (2016.08)

(58) Field of Classification Search

USPC ..... 362/231, 230, 227, 217.01, 211

See application file for complete search history.

(56) References Cited

U.S. PATENT DOCUMENTS

| | | | | |
|---|---|---|---|---|
| 7,465,065 | B2 | 12/2008 | Marka | |
| 2004/0256575 | A1* | 12/2004 | Singer | B82Y 10/00 250/492.2 |
| 2009/0257040 | A1* | 10/2009 | Dinger | G02B 27/0905 355/70 |
| 2010/0226142 | A1* | 9/2010 | Brendle | F21S 48/1388 362/512 |

FOREIGN PATENT DOCUMENTS

| | | |
|---|---|---|
| DE | 20 2007 007 054 U1 | 7/2007 |
| DE | 10 2009 053 795 A1 | 5/2011 |

* cited by examiner

*Primary Examiner* — Edwyn Labaze
(74) *Attorney, Agent, or Firm* — McGlew and Tuttle, P.C.

(57) ABSTRACT

An operating lamp has a lamp body with a lamp surface directed towards a light projection surface. The lamp body has a central axis and the light projection plane extends at a preferred working distance from the lamp surface and at right angles to the central axis. The operating lamp has N light modules arranged on the lamp surface on a first circle with a centroid that coincides with the central axis. The light modules are aligned to each emit a light bundle with a respective principal axis towards the light projection plane—the principal axes forming, with the light projection plane N intersections, an ellipse with a centroid coinciding with the central axis. One of the light modules rotates about a rotation axis that passes through the light module, intersects the central axis has a light bundle principal axis that does not intersect the central axis.

12 Claims, 11 Drawing Sheets

OPERATING LAMP FOR GENERATING A TOTAL LIGHT FIELD CONSISTING OF PARTIAL LIGHT FIELDS

CROSS REFERENCE TO RELATED APPLICATIONS

This application claims the benefit of priority under 35 U.S.C. §119 of German Patent Application 10 2015 004 969.0 filed Apr. 20, 2015, the entire contents of which are incorporated herein by reference.

FIELD OF THE INVENTION

The present invention relates to an operating lamp having a lamp body with a lamp surface directed towards a light projection plane, wherein the lamp body has a central axis, wherein the light projection plane extends at a working distance from the lamp surface and at right angles to the central axis and having a number of light modules.

BACKGROUND OF THE INVENTION

Operating lamps in which a plurality of light modules are provided are known, wherein the individual light modules generate in a light projection plane respective partial light fields, which, superimposed, yield a total light field. A light module usually has here at least one light-emitting diode (LED) for generating light. LEDs are energy-efficient, compact, mechanically robust and have a long service life. Furthermore, an LED can be actuated with different current intensities in order to vary the light intensity of the partial light field generated by the light module. LEDs are relatively inexpensive and are available in desired light colors. One drawback of LEDs is that the heat generated by an LED cannot be removed in the form of heat radiation from the thermally provided LED component, but heat dissipation must be provided via a mechanical mount (heat sink) of the LED light module at the lamp body of the operating lamp.

The total light field generated from the superimposition of partial light fields shall be as homogeneous as possible. A plurality of light modules are therefore usually arranged symmetrically on a lamp surface of the lamp body according to the state of the art. This symmetrical arrangement is usually effected on a lamp surface according to the state of the art such that the light modules are arranged rotationally symmetrically around a central axis of the lamp body.

SUMMARY OF THE INVENTION

An object of the present invention is to provide an operating lamp, in which a plurality of light modules are arranged at the lamp surface in order to generate a homogeneous total light field from individual partial light fields of the individual light modules.

According to the present invention, the operating lamp has a lamp body with a lamp surface directed toward a light projection plane, wherein the lamp body has a central axis, wherein the light projection plane extends at a preferred working distance from the lamp surface and at right angles to the central axis. The operating lamp has a number of at least N light modules, which are arranged at the lamp surface on a first circle, whose centroid (center of gravity) coincides with the central axis, and which are aligned, furthermore, such that they emit a light bundle each with a respective principal axis towards the light projection plane, so that the main axes form N intersections with the light projection plane, and said intersections are located on an ellipse with a centroid that coincides with the central axis, wherein respective adjacent light modules of the N light modules define respective angle ranges in relation to the centroid of the circle, wherein the angle ranges comprise at least one first angle range and at least second angle ranges, and wherein the first angle range differs from every other of the second angle ranges. At least one light module has a rotation in relation to the lamp surface about such a rotation axis which extends through the light module and which intersects, furthermore, the central axis, so that the principal axis of the light bundle corresponding to the rotated light module does not intersect the central axis.

Each of the N light modules preferably has at least one LED lighting element.

The at least one light module preferably has a rotation about its rotation axis in the sense that the principal axis of the light bundle generated by the light module, the rotation axis and the central axis do not form a common two-dimensional plane.

An advantageous embodiment is characterized by a design of the operating lamp wherein the ellipse is a second circle. This advantageous embodiment is characterized in that the N light modules do not form a regular N polygon (imaginary lines interconnecting the N light modules do not form a regular N polygon), and that the principal axes of the light bundles form N intersections with the light projection plane, which said intersections are located on the second circle and which form, further, essentially a regular N polygon.

An advantageous embodiment is characterized by a design of the operating lamp in which the lamp surface is a cutout from a sphere from a spherical surface and wherein an edge of the lamp surface describes a circular section plane, which extends at right angles to the central axis and whose centroid coincides with the central axis.

According to another advantageous embodiment, the operating lamp is characterized in that at least one light module has a plurality of LED lighting elements, which emit respective partial light bundles with respective partial principal axes towards the light projection plane, so that the respective partial principal axes of the respective partial light bundles form identical partial intersections with the light projection plane, which said partial intersections coincide with the intersection of the principal axis of the light bundle of the light module.

According to another advantageous embodiment, the operating lamp is characterized in that the plurality of LED lighting elements comprise at least one first white LED lighting element and at least one second white LED lighting element, wherein the first white LED lighting element has a different correlated color temperature than the second white LED lighting element.

According to another advantageous embodiment, the operating lamp is characterized in that an LED lighting element has a white LED and an optical element for focusing the light of the white LED.

According to another advantageous embodiment, the operating lamp is designed such that the lamp body on the lamp surface has a camera or an optical aperture in the first angle range.

According to another advantageous embodiment, the operating lamp is designed such that the N light modules form a first group of light modules, wherein the light bundles are first light bundles, wherein the principal axes are first principal axes, characterized in that the operating lamp has, further, a number of additional M light modules, which form a second group of light modules, wherein the M light modules at the lamp surface are arranged, furthermore, on a third circle, whose centroid coincides with the central axis, and are aligned, furthermore, such that they emit respective second light bundles with respective second principal axes towards the light projection plane, so that the respective second principal axes of the second light bundles form respective M intersections with the light projection plane, which said M intersections are located on a fourth circle, whose centroid coincides with the central axis, and that the second principal axes of the second light bundles essentially form a regular M polygon.

According to another advantageous embodiment, the operating lamp is characterized in that the M light modules do not form a regular M polygon in reference to the centroid of the third circle, and that, further, at least one of the M light modules has a rotation in relation to the lamp surface about such a rotation axis that passes through the light module and which intersects, furthermore, the central axis, so that the principal axis of the light bundle, which corresponds to the at least one rotated light module of the M light modules, does not intersect the central axis.

According to another advantageous embodiment, the operating lamp is characterized in that at least one light nodule of the first group and at least one light module of the second group are integrated in a common assembly unit.

The present invention will be described below in detail on the basis of special embodiments based on the figures without limitation of the general idea of the invention. The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
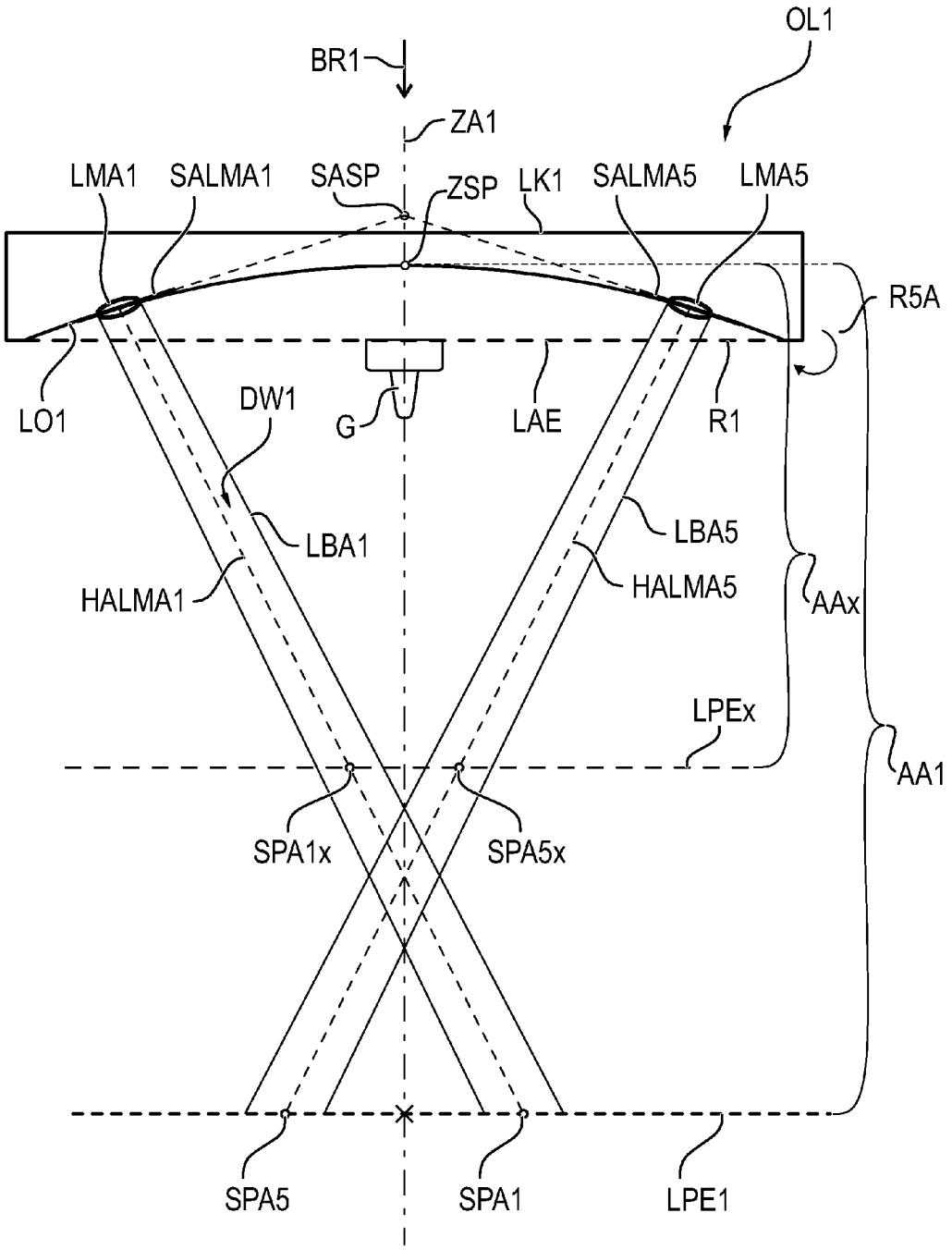
FIG. 1 is a first sectional side view showing an operating lamp according to a first embodiment of the present invention.

Referring to the drawings, FIG. 1 shows an operating lamp OL1 according to the present invention according to a first embodiment, which has a lamp body LK1 with a lamp surface LO1 directed towards a light projection plane LPE1. The lamp surface LO1 is preferably shaped concavely towards the light projection plane LPE1. The lamp body LK1 has a central axis ZA1 and a light emission plane LAE. In the preferred case, in which the lamp surface LO1 is a spherical cutout from a spherical surface, the lamp surface LO1 has a lower edge R1, which describes a circular plane as a light emission plane LAE. The view of the lamp body LK1 from FIG. 1 is a sectional side view of the lamp body LK1.

Figure 2A:
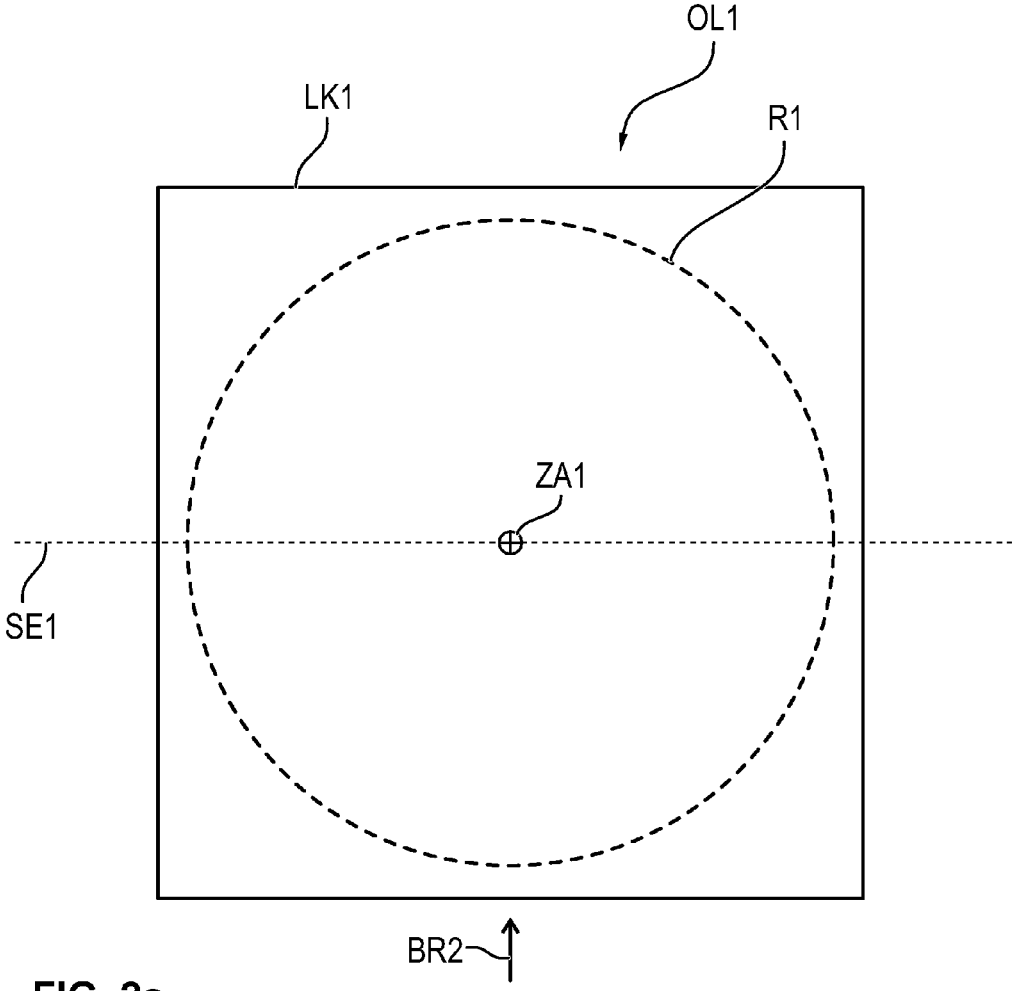
FIG. 2*a* is a top view of the operating lamp according to the present invention according to the first embodiment.

FIG. 2*a* shows a top view of the operating lamp OL1 from the direction of view BR1 from FIG. 1. The section plane SE1, which coincides with the central axis ZA1, is shown as a plane drawn in broken line. The view from FIG. 1 is obtained when cutting through the lamp body LK1 along the section plane SE1 and when viewing the lamp body from a lateral direction of view BR2.

Figure 2B:
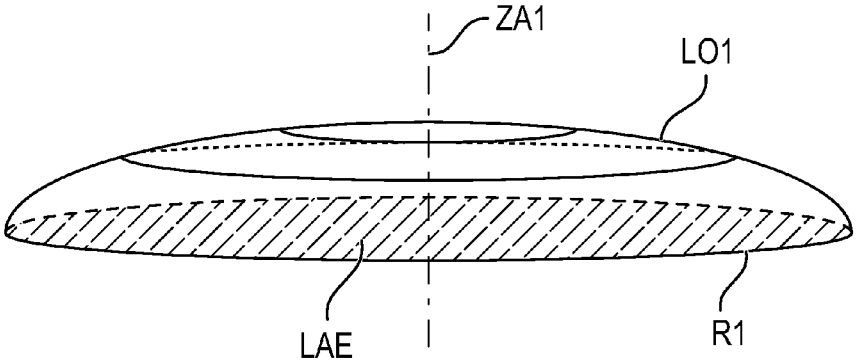
FIG. 2*b* is an oblique view of the lamp surface of the operating lamp according to the present invention according to the first embodiment.

FIG. 2*b* shows an oblique view of the lamp surface LO1 for the preferred case in which the lamp surface LO1 is a spherical segment from a spherical surface. The lower edge R1 of the lamp surface LO1 describes a circular light emission plane LAE in this case.

The lamp surface LO1 does not necessarily have to be a spherical cutout from a spherical surface. It is also possible that the lamp surface LO1 is a circular plane itself, which coincides with the light emission plane LAE from FIG. 2*b* and FIG. 1. Another alternative would be a lamp surface LO1, which is star-shaped, for example, or which is, for example, a regular octagon. It is essential for the present invention that at least N light modules LMA1, LMA5 be arranged at the lamp surface LO1 in relation to the central axis ZA1 such as will be described more specifically below.

It should, furthermore, be noted in reference to FIG. 1 that a light projection plane LPE1, which extends at a preferred working distance AA1 from the lamp surface LO1 and which extends at right angles to the central axis ZA1, is located under the light body LK1. The light projection plane LPE1 has the preferred working distance AA1 from each axis intercept ZSP, at which the central axis ZA1 intersects the lamp surface LO1.

A plurality of at least N light modules LMA1, LMA5 are accommodated at the lamp surface LO1. The light modules LMA1, LMA5 preferably have each at least one LED lighting element so that dissipation of heat is guaranteed by a mechanical mount of the light modules LMA1, LMA5 on the lamp surface LO1 via the lamp body LK1 away from the light modules LMA1, LMA5.

Only two light modules LMA1, LMA5 are shown in FIG. 1 for the sake of clarity, but additional light modules may be provided, as it will also be described later in reference to FIGS. 4*a*, 8*a* and 9*a*.

A lighting module LMA1 is aligned such that it emits a light bundle LBA1 with a principal axis HALMA1 towards the light projection plane LPE1, so that the principal axis HALMA1 forms an intersection SPA1 with the light projection plane LPE1. Likewise, a light bundle LBA5 of the light module LMA5 forms with its principal axis HALMA5 an intersection SPA5 with the light projection plane LPE1.

The light module LMA1 has a rotation axis SALMA1, which passes through the light module LMA1 and which intersects, furthermore, the central axis ZA1. Likewise, the light module LMA5 has a rotation axis SALMA5, which passes through the light module LMA5 and which intersects, furthermore, the central axis ZA1. The rotation axes SALMA1, SALMA5 preferably intersect the central axis ZA1 at an intersection SASP. The selection of the rotation axes SALMA1, SALMA5 will be explained below with reference to FIG. 5.

According to the example shown in FIG. 1, the preferred working distance AA1 is selected to be such that a light module LMA1, LMA5 emits a light bundle LBA1, LBA5 towards the light projection plane LPE1 such that the corresponding principal axis HALMA1, HALMA5 of the light bundle LBA1, LBA5 forms an intersection SPA1, SPA5 with the light projection plane LPE1, which intersection SPA1, SPA5 is located beyond the central axis ZA1 in relation to the central axis ZA1 when viewed from the light module LMA1, LMA5. The further explanations of the different examples will be given below for this selection of the preferred working distance AA1. It is clear to a person skilled in the art that such a preferred working distance AAx with a light projection plane LPEx can also be selected for the operating lamp according to the present invention such that a light module LMA1, LMA5 emits a light bundle LBA1, LBA5 towards the light projection plane LPEx, so that the corresponding principal axis HALMA1, HALMA5 of the light bundle LBA1, LBA5 forms an intersection SPA1*x*, SPA5*x* with the light projection plane LPE1, which intersection is located in front of the central axis ZA1 in relation to the central axis ZA1 as viewed from the light bundle LMA1, LMA5.

Figure 3A:
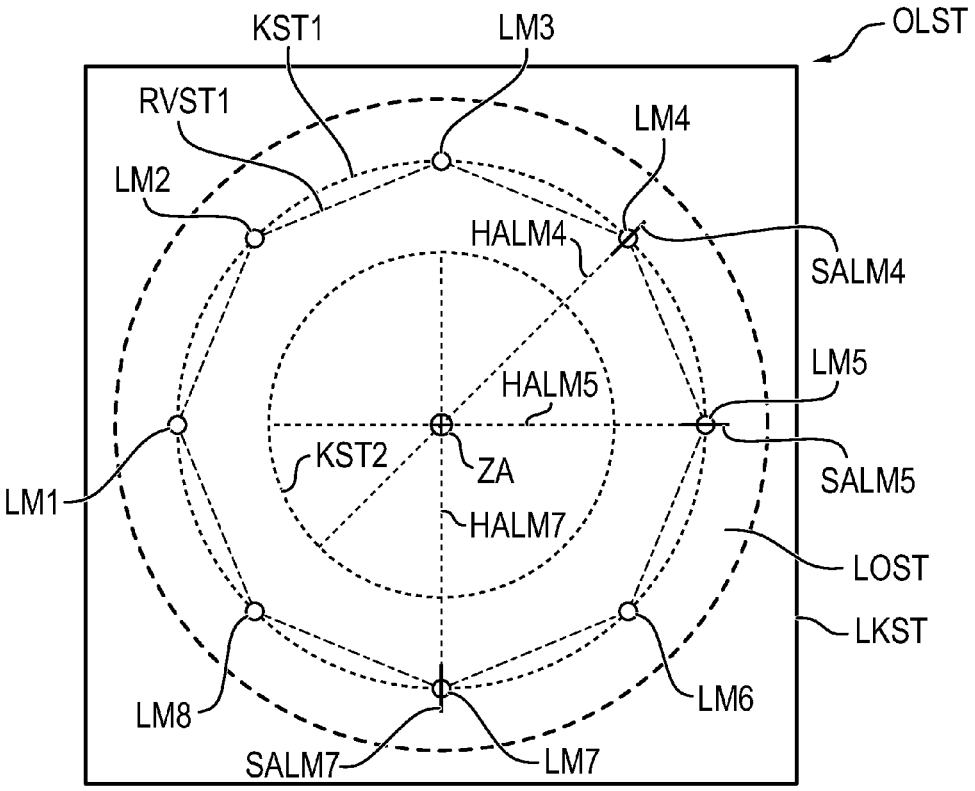
FIG. 3*a* is a view showing an arrangement of light modules on a lamp surface of a lamp body according to the state of the art.
Figure 3B:
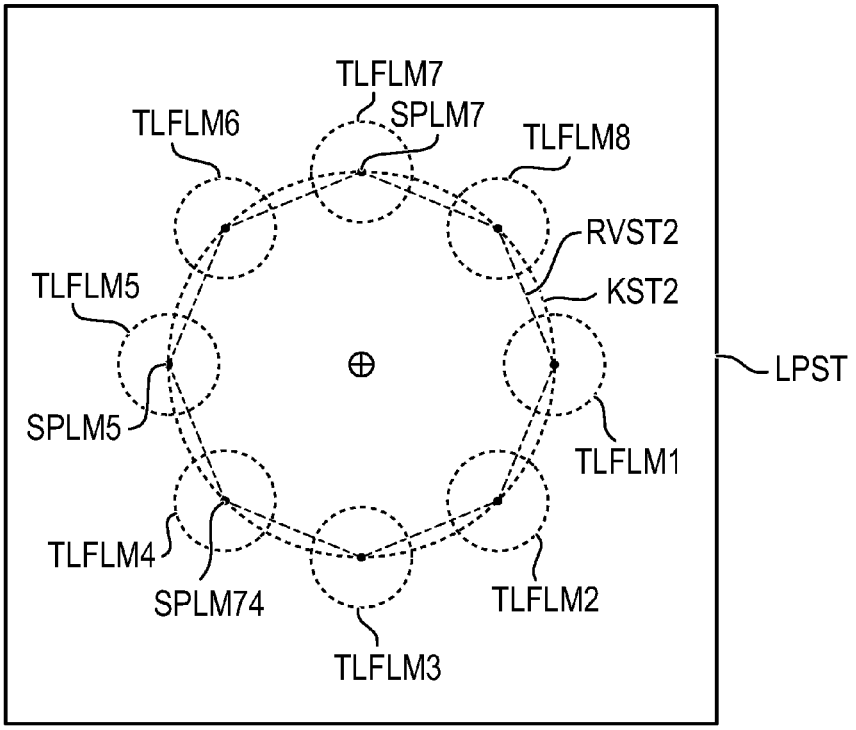
FIG. 3*b* is a view showing a superimposition of partial light fields according to the state of the art.

FIG. 3*a* shows an arrangement of N=8 light modules LM1, . . . , LM8 on a lamp surface LOST of a lamp body LKST of an operating lamp OLST according to the state of the art. FIG. 3*b* shows for this resulting partial light fields TLFLM1, . . . , TLFLM8 on a light projection plane LPEST.

It is assumed in this connection that one lamp body LKST has a central axis ZA. The light modules LM1, . . . , LM8 are arranged on a circle KST1, whose centroid coincides with the central axis ZA. The light modules LM1, . . . , LM8 are aligned, furthermore, such that they emit a light bundle each with a respective principal axis HALM4, HALM5, HALM7 to a light projection plane LPEST, so that the principal axes HALM4, HALM5, HALM7 form N intersections SPLM1, . . . , SPLM8 with the light projection plane LPEST, and these N intersections are located on a second circle KST2, whose centroid coincides with the central axis ZA.

It is customary according to the state of the art to arrange the light modules LM1, . . . , LM8 rotationally symmetrically around the centroid or center of the circle KST1 such, to generate symmetrically arranged partial light fields TLFLM1, . . . , TLFLM8, as is shown in FIG. 3*b*, that a regular polygon RVST1 will be formed.

Further, FIG. 3*a* shows rotation axes SALM4, SALM5, SALM7 of the light modules LM4, LM5, LM7, which pass through the respective light modules LM4, LM5, LM7 and which intersect each the central axis ZA of the lamp body LKST. The light modules LM4, LM5, LM7 are not rotated about their rotation axes SALM4, SALM5, SALM7 because the rotation axes SALM4, SALM5, SALM7 fall into a common two-dimensional plane with the respective principal axes HALM4, HALM5, HALM7 and each with the respective central axis ZA. According to the state of the art, the light modules LM4, LM5, LM7 are aligned with their rotation axes SALM4, SALM5, SALM7 such that the corresponding, respective principal axes HALM4, HALM5, HALM7 of their respective light bundles intersect the central axis ZA. This also applies to the principal axes of light bundles of the additional light modules LM1, LM2, LM3, LM6, LM8 from FIG. 3*a*, which principal axes are not shown here explicitly.

FIG. 3*b* shows a light projection plane LPEST according to the state of the art with the partial light fields TLFLM1, . . . , TLFLM8. Symmetrically arranged partial light fields TLFLM1, . . . , TLFLM8, which are shown in FIG. 3*b*, are obtained according to the state of the art due to the point-symmetrical arrangement of the light modules LM1, . . . , LM8 on the lamp surface LOST and the alignment of the light modules LM1, . . . , LM8 in relation to their respective rotation axes, which pass each through the light modules and the central axis ZA. The intersections SPLM4, SPLM5, SPLM7 of the principal axes HALM4, HALM5, HALM7 are shown explicitly with the light projection plane LPEST in FIG. 3*b* for the principal axes HALM4, HALM5, HALM7 shown in FIG. 3*a*. Additional intersections are shown without special reference numbers in the centers of the partial light fields TLFLM1, TLFLM2, TLFLM3, TLFLM6, TLFLM8.

The intersections SPLM4, SPLM5, SPLM7 of the principal axes HALM4, HALM5, HALM7 lie on a circle KST2, and the partial light fields TLFLM1, . . . , TLFLM8 are arranged rotationally symmetrically to the central axis ZA or to the centroid of the circle KST2, because the individual light modules LM1, . . . , LM8 are aligned according to the state of the art such that the corresponding principal axes of their light bundles intersect the central axis ZA of the lamp body or of the lamp surface. The intersections SPLM4, SPLM5, SPLM7 of the principal axes HALM4, HALM5, HALM7 form a regular polygon RVST2.

Based on the symmetrical arrangement of the partial light fields TLFLM1, . . . , TLFLM8 in reference to the centroid of the circle, a homogeneous distribution of the partial light fields TLFLM1, . . . , TLFLM8 is obtained, so that a homogenous resulting total light field is formed.

Due to a change in the size of the circle KST2, it is possible to generate total light fields, which are located closer to the central axis ZA. It is consequently possible as a result to vary whether a ring-shaped partial light field, as is shown in FIG. 3*b* on the basis of the partial light fields TLFLM1, . . . , TLFLM8, is generated, or whether a central partial light field is generated, in which the intersections of the partial light fields are selected very close or identically to the centroid of the circle KST2.

Figure 4A:
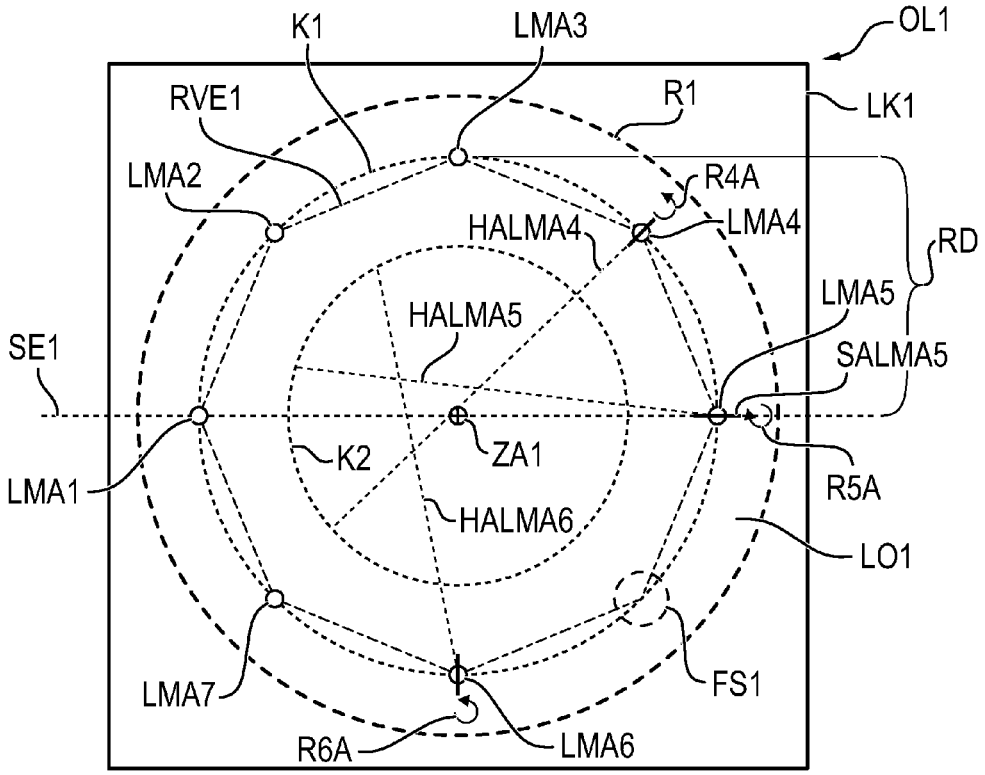
FIG. 4*a* is a view showing an arrangement of light modules on a lamp surface of a lamp body of the operating lamp according to the present invention according to the first embodiment.

FIG. 4*a* shows an arrangement of light modules LMA1, . . . , LMA7 for the case of N=7 light modules according to the operating lamp OL1 according to the present invention according to a first embodiment. The example for N=7 is selected here for illustration only, as the variable N may also assume values greater than 7 or less than 7. The principle of the arrangement of the light modules LMA1, . . . , LMA7, which will be described below, should be borne in mind in order to achieve the advantage according to the present invention.

FIG. 4*a* shows not only the light modules LMA1, LMA5 from FIG. 1, but also the additional light modules LMA2, LMA3, LMA4, LMA6 as well as LMA7. The light modules LMA1, . . . , LMA7 are arranged on a circle K1, whose centroid coincides with the central axis ZA1.

For the light modules LMA4, LMA5, LMA6, FIG. 4*a* shows the respective principal axes HALMA4, HALMA5, HALMA6 of the respective light bundles, which are emitted towards the light projection plane LPE1, as will be described later in reference to FIG. 4*b*. The additional principal axes of light bundles of the additional light modules LMA1, LMA2, LMA3, LMA7 are not shown here explicitly for reasons of illustration.

FIG. 6 shows once again the operating lamp OL1 with the arrangement of the light modules LMA1, . . . , LMA7 on the lamp surface LO1 of the lamp body LK1. It can be seen that adjacent light modules define respective angle ranges WB1, . . . , WB7 in reference to the centroid of the circle K1 and in reference of the central axis ZA1. A first angle range WB5 differs here from all other of the respective second angle ranges WB1, WB2, WB3, WB4, WB6, WB7. The first angle range WB5 is greater in the example being shown here than each of the second angle ranges WB1, WB2, WB3, WB4, WB6, WB7. The second angle ranges WB1, WB2, WB3, WB4, WB6, WB7 do not all necessarily have to be equal to one another.

The light modules LMA4, LMA5, LMA6 are shown together with their respective rotation axes SALMA4, SALMA5, SALMA6 in FIG. 4*a*, and these rotation axes SALMA4, SALMA5, SALMA6 pass each through the respective light module LMA, LM5, LMA5 and which intersect, furthermore, the central axis ZA1. Additional rotation axes of additional light modules are not shown explicitly in FIG. 4*a* for reasons of illustration.

Figure 5:
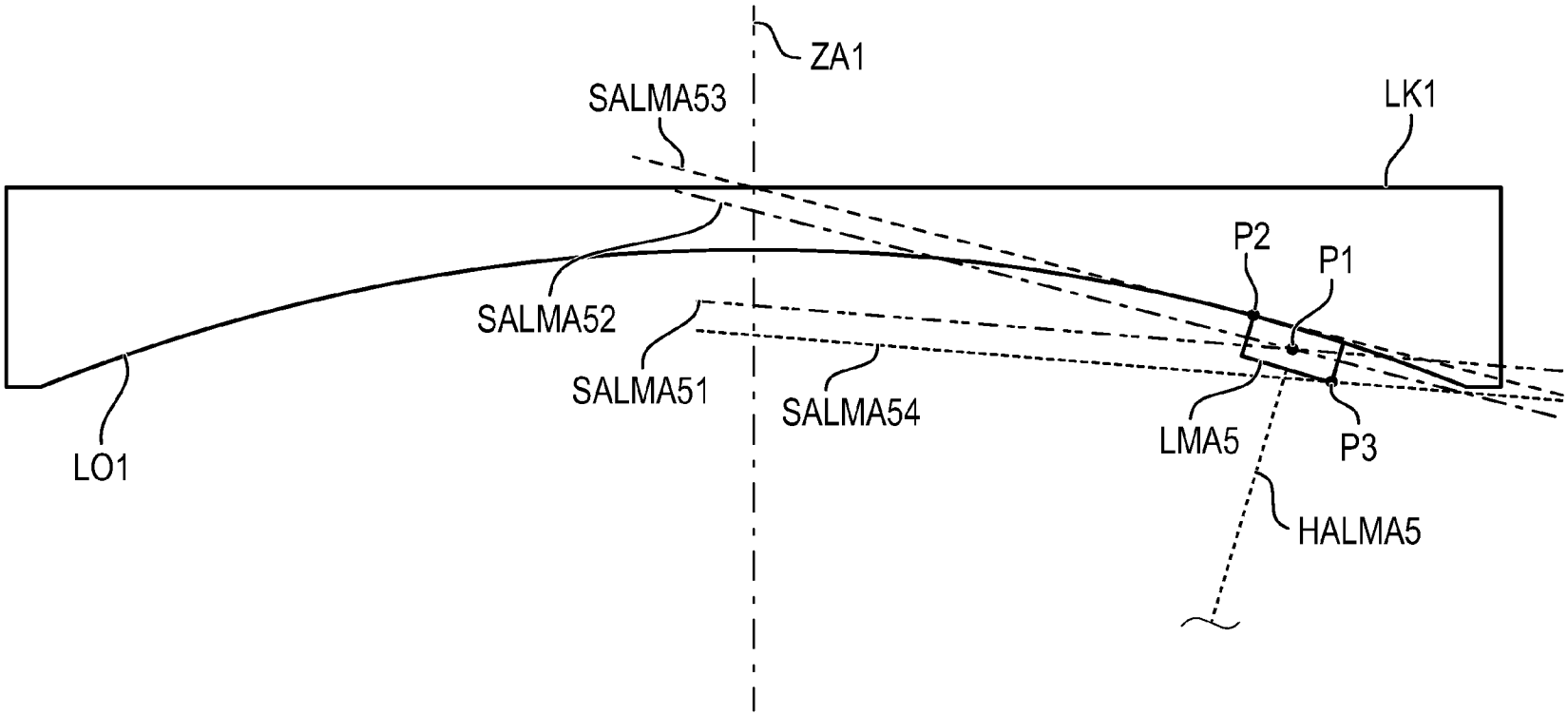
FIG. 5 is a sectional side view of the lamp body of the operating lamp according to the present invention according to the first embodiment together with axes of rotation, which extend each through a light module and which intersect each a central axis of the lamp body.

FIG. 5 shows in this connection different rotation axes SALMA51, SALMA52, SALMA53, SALMA54 for the light module LMA5 as examples for the rotation axis SALMA5 from FIG. 4*a*. All these rotation axes SALMA51, SALMA52, SALMA53, SALMA54 have in common that the rotation axes SALMA51, SALMA52, SALMA53, SALMA54 pass through the light module LMA5 and that they intersect the central axis ZA1. The rotation axis SALMA51 passes through the centroid P1 of the light module LMA5 and intersects the central axis ZA1. The rotation axis SALMA52 likewise passes through the centroid P1 of the light module LMA5 and also intersects the central axis ZA1. The rotation axis SALMA53 passes through a first marginal point P2 of the light point LMA5 and intersects the central axis ZA1. The rotation axis SALMA54 passes through a second marginal point P3 of the light module LMA5 and intersects the central axis ZA1. Around one of these rotation axes SALMA51, SALMA52, SALMA53, SALMA54 the light module LMA5 has a rotation in relation to the lamp surface LO1, as will be described more specifically later.

According to FIG. 4*a*, the light modules LMA4, LMA5, LMA6 are each rotated about their rotation axes SALMA4, SALMA5, SALMA6 in relation to the lamp surface LO1, which is shown by rotations R4A, R5A, R6A. The light modules LMA4, LMA5, LMA6 are rotated each about their rotation axes SALMA4, SALMA5, SALMA6 such that the respective principal axes HALMA4, HALMA5, HALMA6 of the respective light bundles do not intersect the central axis ZA1. The light modules LMA4, LMA5, LMA6 are rotated about their rotation axes SALMA4, SALMA5, SALMA6 in the sense that the respective principal axes HALMA4, HALMA5, HALMA6 of the light bundles generated by the respective light modules LMA4, LMA5, LMA6 do not form a common two-dimensional plane with the respective rotation axes SALMA4, SALMA5, SALMA6 and with the central axis ZA1.

Figure 4B:
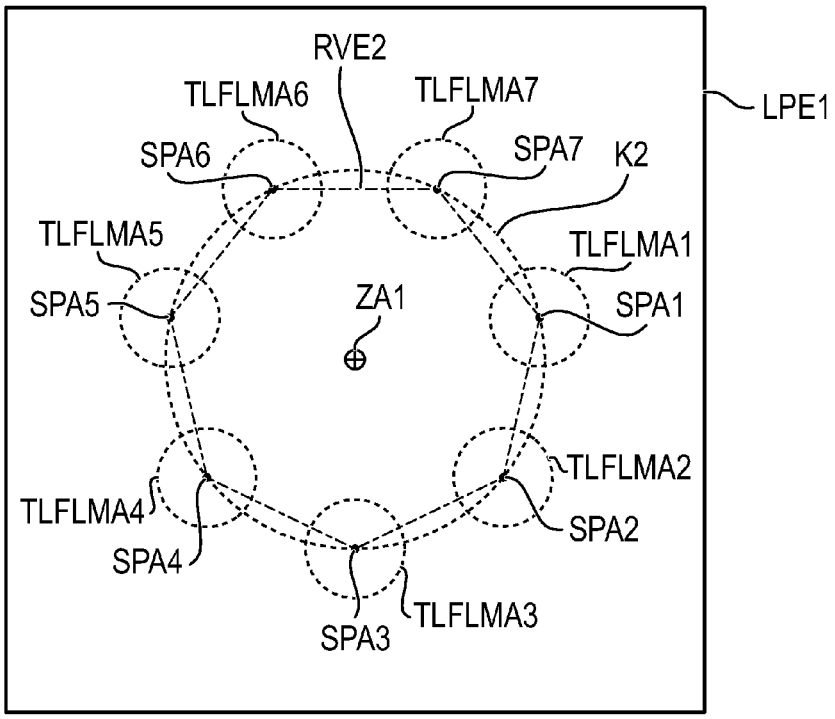
FIG. 4*b* is a view showing resulting partial light fields according to the operating lamp according to the present invention according to a first variant of the first embodiment.

Due to the fact that, as is described in reference to FIG. 3*a*, there is a departure from the alignment of light modules, which alignment is given according to the state of the art, homogenous arrangement of partial light fields now becomes possible, as it is explained now in more detail in reference to FIG. 4*b*, even though the light modules LMA1, . . . , LMA7 are not arranged rotationally symmetrically in reference to the central axis ZA1 on the lamp surface LO1, as it is taught by the state of the art.

FIG. 4*b* shows in this connection the light projection plane LPE1, in which the resulting partial light fields TLFMA1, . . . , TLFMA7 are arranged, according to a first variant of the first embodiment, on a circle K2, whose centroid coincides with the central axis ZA1. The circle K2 may be considered a special case of an ellipse here (An ellipse—a curve on a plane that surrounds two focal points such that the sum of the distances to the two focal points is constant for every point on the curve—is a generalization of a circle, which is a special type of an ellipse that has both focal points at the same location).

When examining now in FIG. 4*a* the intersections SPA4, SPA5 as well as SPA6 of the principal axes HALMA4, HALMA5, HALMA6 with the light projection plane LPE1, it can be established that a shifting of intersections of the principal axes with the light projection plane LPE1 is achieved compared to the arrangement of intersections SPLM4, SPLM5, SPLM6 according to the state of the art on the light projection plane LPEST from FIG. 3*b*. Based on the alignment according to the present invention of the light modules LMA4, LMA5, LMA6 with the mentioned rotation about their respective axes, a homogeneous distribution of the seven partial light fields TLFLMA1, . . . , TLFLMA7 is obtained along the circle K2, which would not be the case for the seven partial light fields TLFLM1, . . . , TLFLM7 of the light projection plane LPEST, because the light field TLFLM8 would be missing for a homogeneous distribution of partial light fields.

The essentially homogeneous distribution of the partial light fields TLFLMA1, . . . , TLFLMA7 from FIG. 4*b* is achieved according to the present invention because of the rotations R4A, R5A, R6A of the light modules LMA4, LMA5, LMA6, so that the principal axes HALMA4, HALMA5, HALMA6 do not intersect the central axis ZA1. Additional rotations of additional light modules in FIG. 4*a* are possible, but they were not shown explicitly in FIG. 4*a* and they are also not described explicitly here. However, such additional rotations of additional light modules can always be derived when examining the resulting partial light fields TLFLMA1, . . . , TLFLMA7. The partial light fields TLFLMA1, . . . , TLFLMA7 form a regular N polygon RVE2 (imaginary lines connecting the partial light fields TLFLMA1, . . . , TLFLMA7 form a regular N polygon RVE2).

It should be noted that in case of an increasing number of N light modules, it is not absolutely necessary to perform a rotation for all N light modules about the rotation axes thereof to generate an approximately homogenous total light field in order to generate an essentially homogeneous total light field, but possibly only a subset of the light modules must have rotations (be rotated so as to not intersect the central axis) according to the present invention.

The advantage of the operating lamp according to the present invention can also be described with the following words:

The object of generating a most homogeneous total light field possible from a superimposition of partial light fields, which are generated by respective light modules, at a certain working distance can also be achieved in case of the operating lamp according to the present invention if the light modules LMA1, . . . , LMA7 are not arranged on a circle rotationally symmetrically to the centroid of the circle or to the central axis ZA1 of the lamp body LK1, but also in the case in which there is explicitly a departure from this. This is achieved by the rotation of at least one light module about each rotation axis, which passes through the light module and which intersects the central axis ZA1 of the lamp surface.

An examination of FIG. 4*a* shows an absence or defect (no light module occupies the space) FS1, at which no light module has to be provided. Such a defect FS1 can then be used for installing another component in the lamp body, and a homogeneous total light field of partial light fields, as is shown in FIG. 4*b*, is still nevertheless obtained according to the present invention. The working distance AA1 from FIG. 1 preferably equals 0.9-1.2 m, and if N=8 is selected, a rotation by preferably 1° of the light modules adjacent to a defect FS1 is performed. Additional modules or light modules are preferably rotated by about 0.5° about their axis of symmetry. If the working distance AA1 at which a symmetrical partial light field is obtained, as is described in FIG. 4*b*, is 1,000 mm, an approximately homogeneous partial light field is generated with the dimensioning of the operating lamp being described here even if the symmetry is broken only nonessentially by an upward shifting or a downward shifting of the operating lamp away from the light projection plane LPE1 and towards the light projection plane LPE1, respectively, so that an approximately homogeneous distribution of the partial light fields is still given for a range of 0.9-1.2 m. Since the angles by which any of the light modules are rotated is relatively small, the effect of a rotation of the light modules in changed distance ranges close to the working distance consequently hardly becomes noticeable due to an asymmetry. The partial light fields likewise remain symmetrically round as best as possible or approximately round. The operating lamp according to the present invention consequently reaches an approximation of a symmetrically superimposed total light field for common working distances of operating lamps even if the light modules LMA1, . . . , LMA7 are not arranged symmetrically on the lamp surface.

Figure 6:
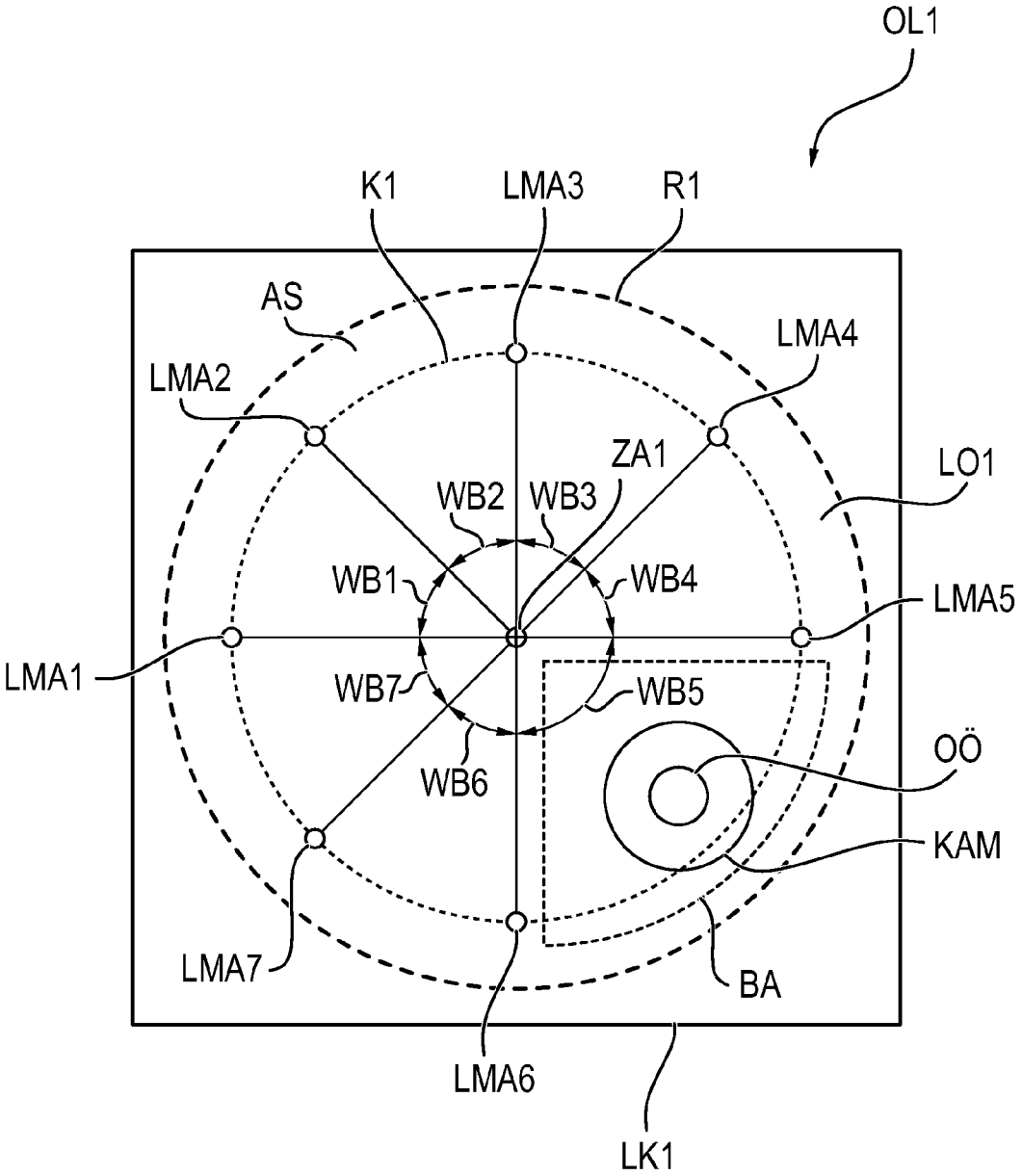
FIG. 6 is a view showing an arrangement of the light modules on the lamp surface of the lamp body of the operating lamp according to the first embodiment with angle ranges shown.

In the area of the absence FS1 shown in FIG. 4*a*, which is in the angle range WB5, FIG. 6 shows a resulting preferred installation space BA. A camera KAM is preferably installed in the lamp body or in the lamp surface LO1 of the lamp body LK1 in the area of this installation space BA.

The provision of the camera KAM in the area of the installation space BA instead of a light module may be provided according to the present invention because a homogeneous distribution of partial light fields is still achieved for generating a homogeneous total light field owing to the described rotations of the light modules.

An integration of a camera in an operating lamp OPL1 according to FIG. 6 can consequently be performed in a relatively comfortable installation space area BA, so that a camera with a higher resolution, a broader zoom range (up to and greater than 100) and with high dynamics (300,000 Lux to 100 Lux) can be provided. Cameras with such requirements require a certain installation space, which is provided according to the present invention as the installation space BA. Such a camera is preferably used to detect images from an area of the light projection plane and to transmit them to a display device, which may be provided separately from the operating lamp. Outside observers can thus comfortably observe the surgical procedures. Such cameras are usually provided centrally in the lamp along the central axis of the lamp surface or lamp body according to the state of the art. However, a camera competes for such a position with, for example, control or aligning grips of the operating lamp or even flow holes for facilitating laminar flow around the operating lamp. This central position along the central axis ZA1 is not consequently provided according to the present invention for the camera KAM, so that this position may be provided for other devices, e.g., a grip. A grip G is shown as an example for this in FIG. 1.

The camera KAM installed in the lamp surface LO1 does not require a sterile coating of its own, but may be fully integrated in the lamp body. If the lamp body LK1 is covered by a cover plate along its light emission plane LEA, the camera KAM provided according to FIG. 6 as well as the light modules arranged at the lamp surface are already protected from dust and moisture. Such a cover plate AS, indicated by a shading AS in FIG. 6, provides a large, flat, wipeable and disinfectable surface, which can be used as a transparent disk for the camera KAM. An optical aperture OÖ for a camera may also be provided within the installation space BA instead of the camera. Consequently, the operating lamp according to the present invention preferably has a transparent and essentially flat cover plate AS, which covers the light emission plane and which is sealed towards the lamp body LK1. Such a cover plate sealing the light emission plane AS can be wiped off or disinfected in one operation, so that no additional wiping or no additional disinfection of the camera KAM or of an optical aperture OÖ is necessary. It is consequently unnecessary to provide the camera KAM or the optical aperture OÖ in a central area, such as the grip G, as a result of which the requirement that a part located there be able to be sterilized or autoclaved is eliminated.

It should be noted in reference to the first embodiment of the operating lamp according to the present invention shown in FIG. 4*a* that the N light modules LMA1, . . . , LMA7 are arranged along the circle K1 with a radius RD. Further, a regular octagon RVE1 is seen in FIG. 4*a* (based on imaginary lines connecting light modules LMA1, . . . , LMA7 and absence location FS1). An examination of FIG. 4*a* shows clearly that the N light modules do not form a regular polygon RVE1, because, due to an absence FS1, one light module, which would be necessary for forming such a regular octagon RVE1, is missing. The N light modules likewise fail to form a regular heptagon, i.e., a regular N polygon. The light modules LMA1, . . . , LMA7 are arranged at an equal radial distance RD around the central axis ZA1. The light modules LMA1, . . . , LMA7 are not arranged rotationally symmetrically. Consequently, an absence FS1 is obtained.

Figure 4C:
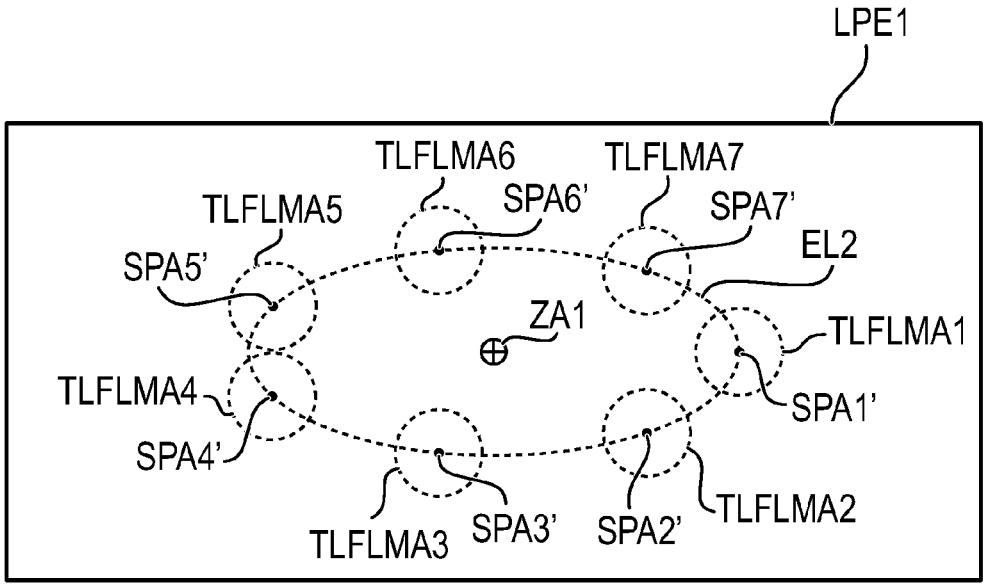
FIG. 4*c* is a view showing resulting partial light fields according to the operating lamp according to the present invention according to a second variant of the first embodiment.

FIG. 4*c* shows resulting partial light fields TLFLMA1, . . . , TLFLMA7 on the light projection plane LPE1 according to a second variant of the first embodiment for the case in which the angles of the respective principal axes of the respective light bundles for one or more of the light modules LMA1, . . . , LMA7 relative to the central axis ZA1 are changed compared to the first variant of the first embodiment.

The partial light fields TLFLMA1, . . . , TLFLMA7 are arranged along an ellipse EL2. Intersections SPA1', . . . , SPA7' of the principal axes of the light bundles of the respective light modules LMA1, . . . , LMA7, which are located on the ellipse EL2, are obtained because of the rotations R4A', R5A', R6A' of the light modules LMA4, LMA5, LMA6 as well as additional possible rotations of light modules. An essentially homogeneous total light field, which would not be obtained through the teaching according to the state of the art, is obtained here as well due to the rotations R4A', R5A', R6A' of the light modules LMA4, LMA5, LMA6 as well as additional possible rotations of light modules.

Figure 10:
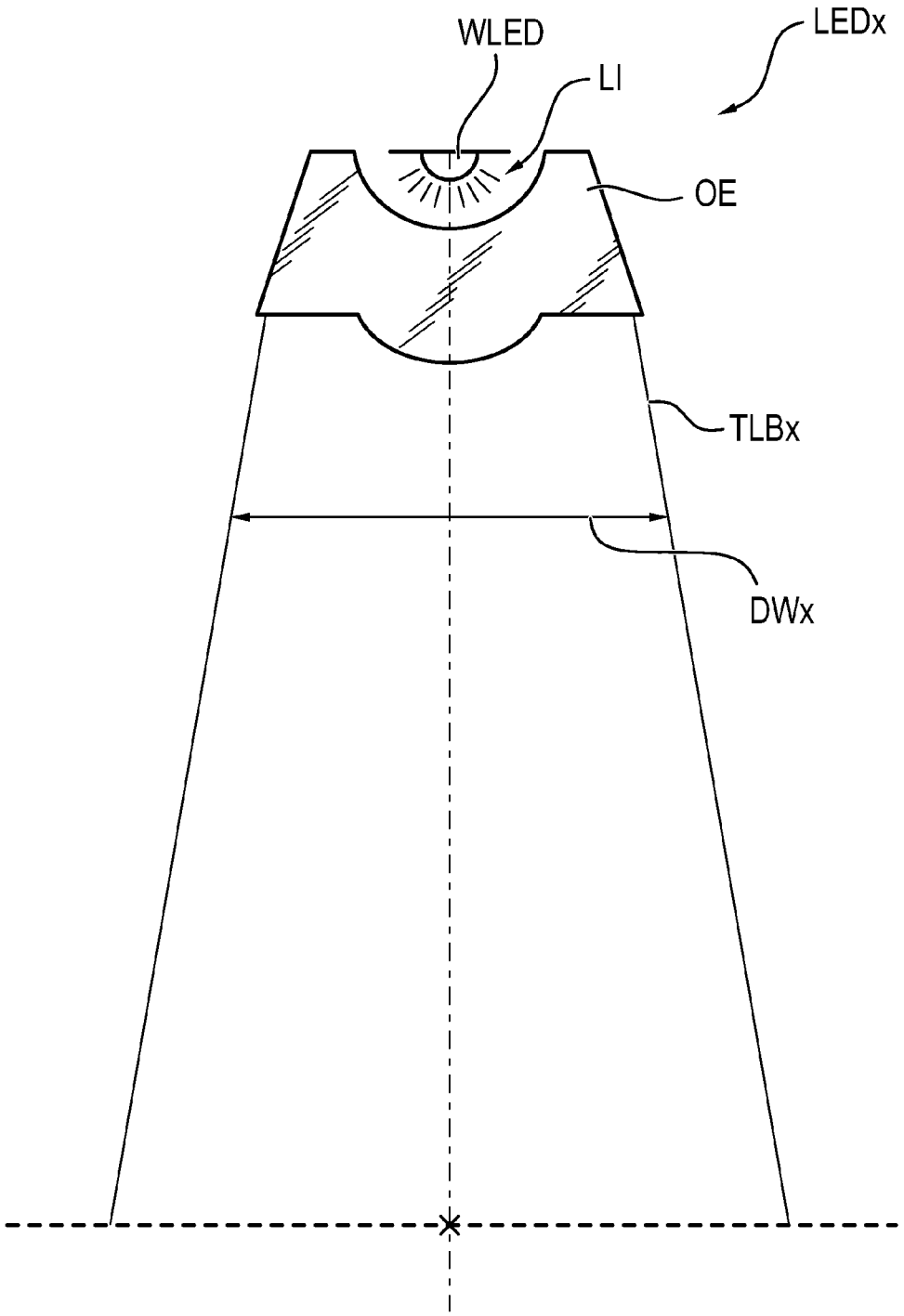
FIG. 10 is a view showing a preferred variant of a light module.

FIG. 10 shows an LED lighting element LEDx, which has a white LED WLED and an optical element OE for focusing the light LI of the LED WLED, so that the partial light bundle TLBx of the LED lighting element LEDx has a divergence angle DWx. Such a divergence angle DWx is shown as a divergence angle DW1 in FIG. 1. If such a divergence angle DWx, DW1 is selected such that it is greater than an angle of rotation of a light module, the divergence angle DWx, DW1 has a greater effect on the light field geometry and the symmetry of the resulting total light field, so that the resulting total light field likewise remains relatively homogeneous and symmetrical at distances around the working distance AA1.

Figure 7:
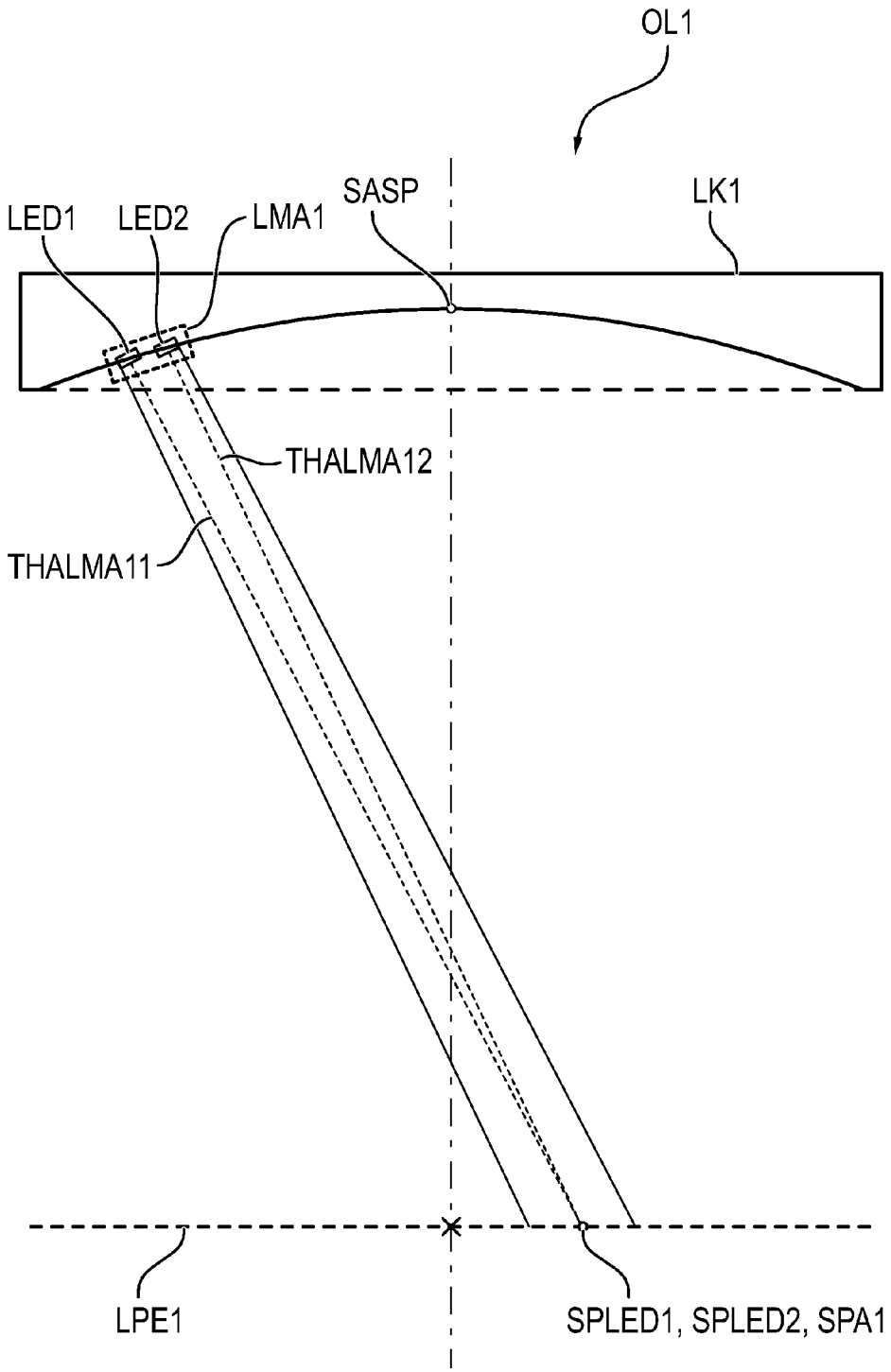
FIG. 7 is a view showing a preferred exemplary embodiment of a light module, which has a plurality of LED lighting elements.

FIG. 7 shows a light module LMA1 in a preferred embodiment. The light module LMA1 has a plurality of LED lighting elements LED1, LED2 here, which emit respective partial light bundles with respective partial principal axes THALMA11, THALMA12 to the light projection plane LPE1. The respective partial principal axes THALMA11, THALMA12 form identical intersections SPLED1, SPLED2 with the light projection plane LPE1 at the location of the intersection SPA1. This makes it possible the use a plurality of LED lighting elements LED1, LED2 within a light module LMA1 to reach a necessary minimum light intensity. Fitting the lamp surface with light modules over a large area in a surface-covering manner makes it possible to compensate partial shadowings of the lamp body, which may also be defined as the avoidance of the formation of cast shadows.

The LED lighting element LED1 is preferably a first white LED lighting element and the lighting element LED2 is a second white LED lighting element The first white LED lighting element preferably has another correlated color temperature here than the second white LED lighting element LED2. The operating lamp OL1 preferably has an actuating device in order to mix the respective light intensities of the respective different, correlated color temperatures by different actuating currents. The resulting color temperature of the superimposed partial light fields from the individual LED lighting elements LED1 and LED2 can consequently be controlled. The correlated color temperature of the first white LED lighting element LED1 preferably equals 3200 Kelvin. The correlated color temperature of the second white LED lighting element LED2 preferably equals 7000 Kelvin.

Figure 8A:
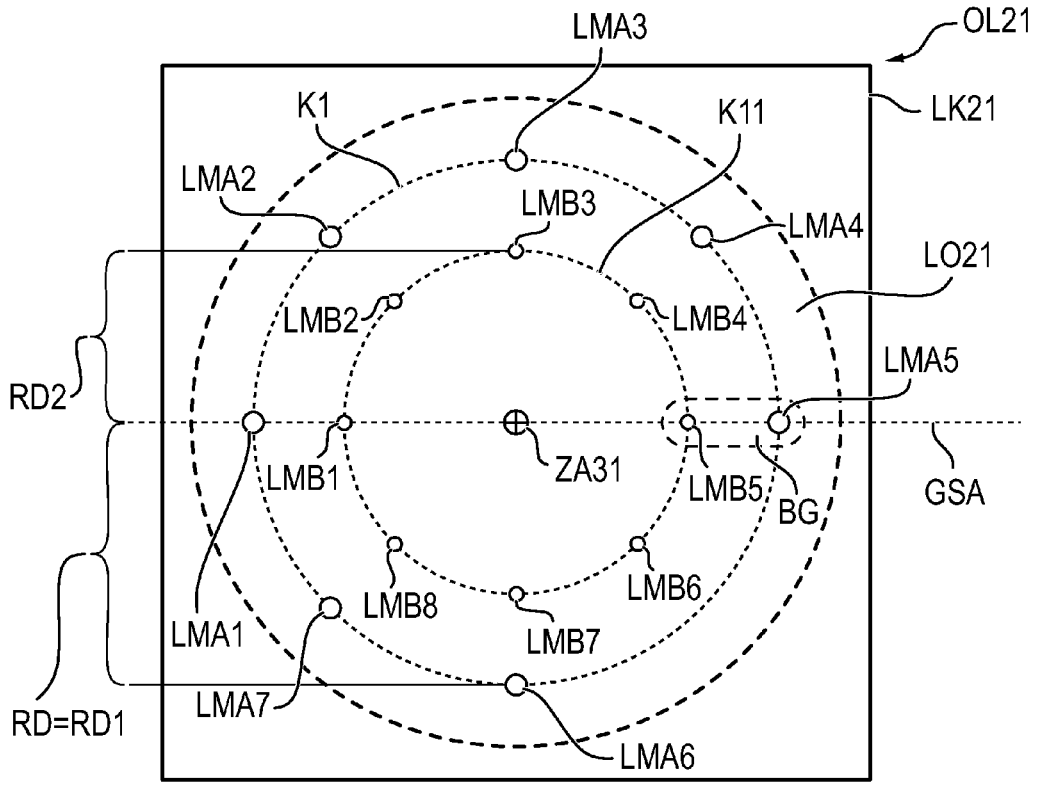
FIG. 8*a* is a view showing an arrangement of two groups of light modules on a lamp surface of a lamp body of the operating lamp according to a first variant of a second embodiment.
Figure 8B:
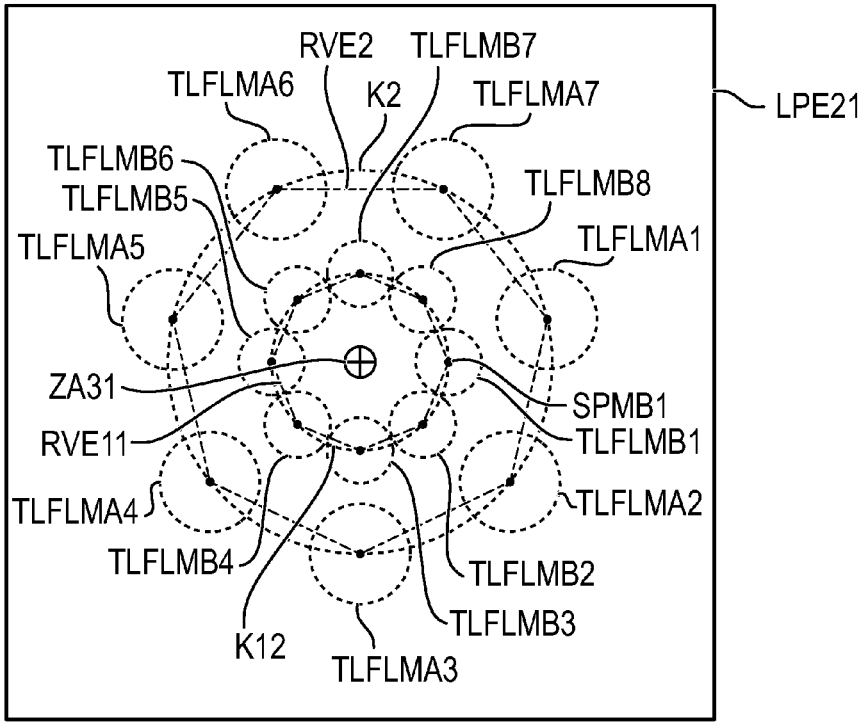
FIG. 8*b* is a view showing resulting partial light fields according to the operating lamp according to the first variant of the second embodiment.

FIG. 8*a* shows a first variant of a second embodiment of the operating lamp OL21 according to the present invention. The operating lamp OL21 has the N light modules LMA1, . . . , LMA7 of the operating lamp OL1 of the first exemplary embodiment, as was described in detail before. The N light modules LMA1, . . . , LMA7 form a first group of light modules. The radial distance RD is consequently a first radial distance RD1. These first light modules LMA1, . . . , LMA7 are aligned such that they emit respective light bundles towards a light projection plane, as was described before in reference to FIGS. 4*a* and 4*b*.

The operating lamp OL21 has, furthermore, a number of additional M light modules LMB1, . . . , LMB8, which form a second group of light modules. These light modules LMB1, . . . , LMB8 of the second group of light modules are also inserted into the lamp surface via mechanical mounts. The number of light modules LMB1, . . . , LMB8 of the second group equals, for example, M=8 in this example of the first variant of the second embodiment Additional numerical values of M are, of course, possible and may be provided by the person skilled in the art.

The light modules LMB1, . . . , LMB8 of the second group are arranged on a third circle K11, whose centroid coincides with the central axis ZA31 of the lamp body LK21. The radial distance RD2 of the light modules of the second group around the central axis ZA31 is consequently a second radial distance RD2. The radii RD1, RD2 of the circles K1 and K11 from FIG. 8*a* may be different. As an alternative, the radii RD1, RD2 may also be equal, in which case a shifting of the lighting elements LMB1, . . . , LMB8 of the second group is carried out on the circle K11 such that the light modules LMB1, . . . , LMB8 of the second group can be positioned between the light modules LMA1, . . . , LMA7 of the first group.

According to the first variant of the second embodiment from FIG. 8*a*, the light modules LMB1, . . . , LMB8 are arranged in relation to the centroid of the circle K11 such that they form a regular M polygon, which is not shown explicitly.

FIG. 8*a* shows a resulting total light field in a light projection plane LPE21 for the first variant of the second exemplary embodiment. The light modules of the second group are aligned such that they emit respective light bundles with a respective principal axis towards the light projection plane LEP31, so that the principal axes form intersections SPMB1, . . . , SPMB8 with the light projection plane LPE21, which intersections are located on a fourth circle K12, which has a centroid that coincides with the central axis ZA31.

The intersections SPMB1, . . . , SPMB8 of the principal axes of the light bundles of the light modules of the second group form a regular M polygon RVE11 here.

By providing different groups of light modules, it becomes possible in the resulting total light field of the light projection plane LPE21 to adjust the diameter of the total light field by the different light modules of the first and second groups being able to be actuated with different actuating currents in order to bring about different light intensities of the partial light fields of the first group and from the second group.

One or more of the light modules LMA1, . . . , LMA7, LMB1, . . . , LMB8 may preferably have a plurality of LED lighting elements, as was described before in reference to FIG. 7. As was described before, different white LED lighting elements with different correlated color temperatures are preferably provided in one light module. An adjustment of the diameter of the total light field as well as control of the color temperature are achieved hereby at the same time.

In case a light module LMA5 of the first group is arranged with a light module LMB5 of the second group along a common axis GSA, which intersects the central axis ZA3 of the lamp body LK31, such light modules LMA5, LMB5 of different groups may also be integrated in a common assembly unit BG.

Figure 9A:
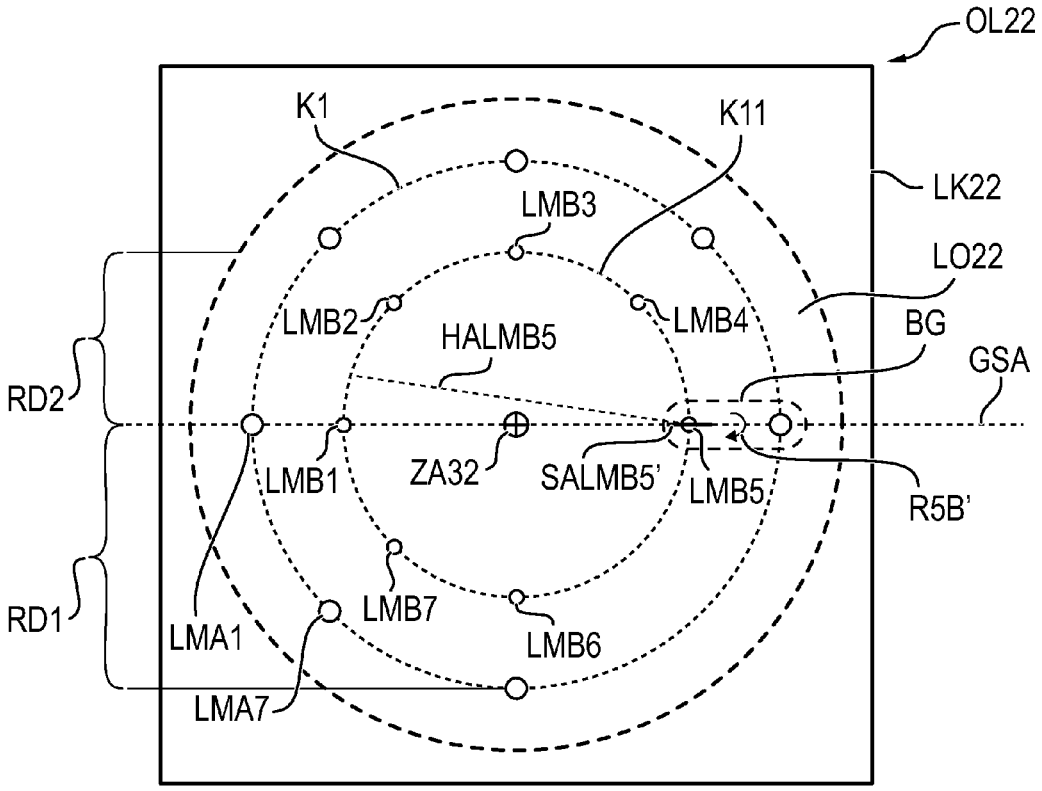
FIG. 9*a* is a view showing an arrangement of two groups of light modules on a lamp surface of a lamp body according to a second variant of the second embodiment of the operating lamp according to the present invention.

FIG. 9*a* shows a second variant of the third embodiment of the operating lamp OL22 according to the present invention. The operating lamp OL22 has the N light modules LM1, . . . , LMA7 of the operating lamp OL1 of the first exemplary embodiment, as was described in detail above. The operating lamp OL22 has, furthermore, a number of additional M light modules LMB1, . . . , LMB7, which form a second group of light modules. These light modules LMB1, . . . , LMB7 of the second group of light modules are also inserted via mechanical mounts into the lamp surface. The number of light modules LMB1, . . . , LMB7 of the second group equals, for example, M=7 in this example of the second variant of the second embodiment. Additional numerical values of M are, of course, possible and may be provided by the person skilled in the art.

Figure 9B:
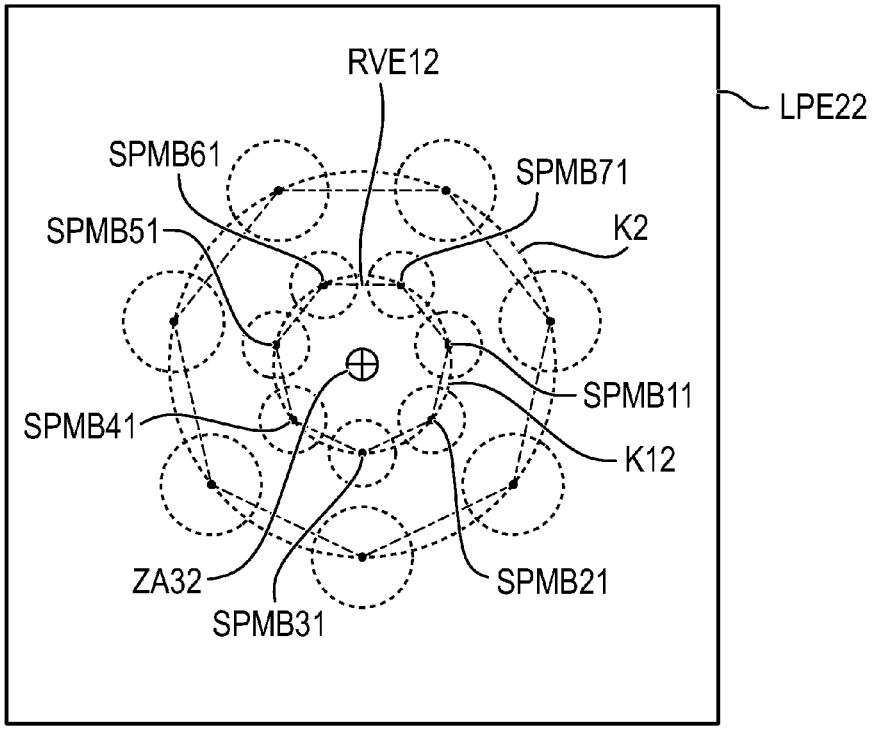
FIG. 9*b* is a view showing resulting partial light fields according to the operating lamp according to the second variant of the second embodiment.

The light modules LMB1, . . . , LMB7 are arranged such as was described above according to the present invention in reference to FIGS. 4*a*, 4*b*, 4*c*, 5 and 6 for the light modules LMA1, . . . , LMA7. Consequently, at least one of the light modules LMB5 of the second group is rotated about its rotation axis SALMB5', which passes through the light module LMB5 and which intersects the central axis Z32, by a degree of rotation R5B' in relation to the lamp surface LO22 such that the principal axis HALMB5 does not intersect the central axis ZA1. It is consequently achieved that the resulting partial light fields shown in FIG. 9*b* are distributed essentially homogeneously on the circle K12 and they form a homogeneous total light field. Consequently, M light modules LMB1, . . . , LMB7 of the second group are arranged in relation to the centroid of the circle K11 such that they do not form a regular M polygon. The M light modules LMB1, . . . , LMB7 of the second group are aligned such that they emit two light bundles each with respective second principal axes towards the light projection plane LPE22, so that the second principal axes of the second light bundles form M intersections SPMB11, . . . , SPMB71 with the light projection plane LPE22, which intersections are located on the circle K12, whose centroid coincides with the central axis ZA32. The intersections SPMB11, . . . , SPMB71 of the second principal axes form a regular M polygon RVE12.

One or more of the light modules LMB1, . . . , LMB7 may preferably have a plurality of LED lighting elements, as was described before with reference to FIG. 7. Different white LED lighting elements of different correlated color temperature are preferably provided in a light module, as was described above. An adjustment of the diameter of the total light field as well as control of the color temperature are achieved by this at the same time.

In case a light module LMA5 of the first group is arranged with a light module LMB5 of the second group along a common axis of symmetry GSA, which intersects the central axis ZA3 of the lamp body LK32, such light modules LMA5, LMB5 of different groups may also be integrated in a common assembly unit BG.

While specific embodiments of the invention have been shown and described in detail to illustrate the application of the principles of the invention, it will be understood that the invention may be embodied otherwise without departing from such principles.

APPENDIX

| List of Reference Numbers | |
|---|---|
| Working distance | AA1, AAx |
| Cover plate | AS |
| Assembly unit | BG |
| Installation space | BA |
| Direction of view | BR1, BR2 |
| Divergence angle | DWx, DW1 |
| Ellipse | EL2 |
| Absence | FS1 |
| Grip | G |
| Common axis of symmetry | GSA |
| Principal axis | HALM4, HALM5, HALM7, HALMA1-HALMA8, HALMB5 |
| Circle | K1, K2, K11, K12 |
| Camera | KAM |
| Light emission plane | LEA |
| Light bundle | LBA1, LBA5 |
| LED lighting element | LEDx, LED1, LED2 |
| Light | LI |
| Lighting body | LK1, LK21, LK22, LKST |
| Light module | LM1-LM8, LMA1-LMA8, LMB1-LMB8 |
| Lamp surface | LO1, LO21, LO22, LOST |
| Light projection plane | LPE1, LPE21, LPE22, LPEST |
| Optical element | OE |
| Operating lamp | OL1, OL21, OL22, OST |
| Optical aperture | OÖ |
| Edge | R1, R2 |
| Rotation | R4A, R5A, R6A, R5B' |
| Radial distance | RD, RD1, RD2 |
| Polygon | RVE1, RVE2, RVST1, RVST2 |
| Rotation axis | SALM4, SALM5, SALM7, SALMA1-SALMA8, SALMB5' |
| Section plane | SE1 |
| Intersection | SPA1-SPA7, SPA1'-SPA7', SASP, SPLED1, SPLED2, PLM14, SPLM5, SPLM7, SPMB1-SPMB8, SPMB11-SPMB71 |
| Partial principal axes | THALMA11, THALMA12 |
| Partial light bundle | TLBx |
| Partial light fields | TLFLM1-TLFLM8, TLFLMA1-TLFLMA7 |
| Angle range | WB1-WB7 |
| White LED | WLED |
| Central axis | ZA, ZA1, ZA31, ZA32 |
| Axis intercept | ZSP |

What is claimed is:

1. An operating lamp comprising:

a lamp body with a lamp surface directed towards a light projection plane, wherein the lamp body has a central axis, wherein the light projection plane extends at a working distance from the lamp surface and at right angles to the central axis;

a plurality of N light modules arranged at the lamp surface on a first circle having a centroid that coincides with the central axis, wherein:

the plurality of light modules are aligned to each emit a light bundle with a respective principal axis towards the light projection plane, so that the respective principal axes form, with the light projection plane, N respective intersections which are located on an ellipse with a centroid that coincides with the central axis;

respective adjacent light modules of the N light modules define respective angle ranges with reference to the centroid of the first circle;

the angle ranges comprise at least a first angle range and at least second angle ranges;

the first angle range differs from each angle range of the at least second angle ranges;

at least one of the N light modules is rotated in relation to the lamp surface about a rotation axis which passes through the light module and which intersects the central axis such that the principal axis of the light bundle, corresponding to the at least one of the N light modules that is rotated, does not intersect the central axis;

the principal axis of the light bundle generated by the light module that is rotated about the rotation axis, the rotation axis and the central axis do not form a common two-dimensional plane; and the lamp body has a camera or an optical aperture at the lamp surface in the first angle range;

the ellipse is a second circle;

the N light modules do not form a regular N polygon;

the respective principal axes of the light bundles form the respective intersections with the light projection plane, such that the respective N intersections are located on the second circle and form essentially a regular N polygon.

2. An operating lamp in accordance with claim 1, wherein the lamp surface is a spherical segment from a spherical surface.

3. An operating lamp in accordance with claim 1, wherein at least one of the N light modules has a plurality of LED lighting elements, which each emit partial light bundles with respective partial principal axes towards the light projection plane, so that the respective partial principal axes form respective identical partial intersections with the light projection plane.

4. An operating lamp in accordance with claim 3, wherein:

the plurality of LED lighting elements comprise at least one first white LED lighting element and at least one second white LED lighting element;

the first white LED lighting element has a different correlated color temperature than the second white LED lighting element.

5. An operating lamp in accordance with claim 3, wherein at least one of the LED lighting elements has a white LED and an optical element for focusing light of the white LED.

6. An operating lamp in accordance with claim 1, wherein:

the N light modules form a first group of light modules;

the light bundles are first light bundles;

the principal axes are first principal axes, the operating lamp further comprising:

a plurality of additional M light modules, which form a second group of light modules, wherein the M light modules are arranged at the lamp surface on a third circle having a centroid coinciding with the central axis;

the M light modules are aligned to emit respective second light bundles with respective second principal axes towards the light projection plane, so that the respective second principal axes form with the light projection plane respective M intersections, which are located on a fourth circle having a centroid that coincides with the central axis;

the M intersections of the second principal axes of the second light bundles form essentially a regular M polygon.

7. An operating lamp in accordance with claim 6, wherein the M light modules do not form a regular M polygon in relation to the centroid of the third circle;

at least one of the M light modules is rotatable in relation to the lamp surface about a rotation axis which passes through the at least one light module of the M light modules and which intersects, furthermore, the central axis, so that the principal axis of the light bundle, which corresponds to the at least one rotatable light module of the M light modules, does not intersect the central axis.

8. An operating lamp in accordance with claim 6, wherein at least one light module of the first group and at least one light module of the second group are integrated in a common assembly unit.

9. An operating lamp comprising:

a lamp body with a lamp surface directed towards a light projection plane, wherein the lamp body has a central axis, wherein the light projection plane extends at a working distance from the lamp surface and at right angles to the central axis;

a plurality of N light modules arranged at the lamp surface on a first circle having a centroid that coincides with the central axis, wherein:

the plurality of light modules are aligned to each emit a light bundle with a respective principal axis towards the light projection plane, so that the respective principal axes form, with the light projection plane, N respective intersections which are located on an ellipse with a centroid that coincides with the central axis;

respective adjacent light modules of the N light modules define respective angle ranges with reference to the centroid of the first circle;

the angle ranges comprise at least a first angle range and at least second angle ranges;

the first angle range differs from each angle range of the at least second angle ranges;

at least one of the N light modules is rotated in relation to the lamp surface about a rotation axis which passes through the light module and which intersects the central axis such that the principal axis of the light bundle, corresponding to the at least one of the N light modules that is rotated, does not intersect the central axis;

the principal axis of the light bundle generated by the light module that is rotated about the rotation axis, the rotation axis and the central axis do not form a common two-dimensional plane;

the lamp body has a camera or an optical aperture at the lamp surface in the first angle range;

at least one of the N light modules has a plurality of LED lighting elements, which each emit partial light bundles with respective partial principal axes towards the light projection plane, so that the respective partial principal axes form respective identical partial intersections with the light projection plane.

10. An operating lamp for illuminating a light projection plane, the operating lamp comprising:

a lamp body;

a plurality of light modules mounted on said lamp body on a light module circle having a centroid, said lamp body having a central axis passing through said centroid and perpendicular to said light module circle, said plurality of light modules being arranged non-symmetrically on said light module circle, each of said plurality of light modules emitting a light bundle with a principal axis of emission and forming a respective light intersection with the light projection plane, said plurality of light modules being arranged to have said light intersections arranged on the light projection plane in an ellipse with a centroid coinciding with said central axis;

each of a subset of said plurality of light modules being rotatably connected to said lamp body about a rotation axis, each said rotation axis passes through a respective said light module and intersects said central axis, wherein:

said each light module of said subset is arranged on a respective said rotation axis to arrange a respective said principal axis of a respective said light bundle to not intersect said central axis;

said each light module of said subset is arranged on said respective rotation axis to arrange said respective principal axis, said respective rotation axis and said central axis to not form a common two-dimensional plane;

said each light module of said subset is arranged on said respective rotation axis to symmetrically arrange all of said light intersections on the light projection plane on said ellipse.

11. An operating lamp in accordance with claim 10, wherein:

each of said light modules is angularly spaced with respect to said centroid of said light module circle from an adjacent one of said light modules by an angular distance, one of said angular distances being different than a remainder of said angular distances.

12. An operating lamp in accordance with claim 10, further comprising:

an optical component receiving, and processing, light reflected from the light projection plane, said optical component being mounted on said lamp body, said optical component and said plurality of light modules being symmetrically arranged on said light module circle.

* * * * *